US005281158A

United States Patent [19]

Lin

[11] Patent Number: 5,281,158

[45] Date of Patent: Jan. 25, 1994

[54] LIGHT SOCKET AND SOCKET ADAPTER

[76] Inventor: Wen-Hsiung Lin, 5F, No. 10-1, Hoping Road, Pan Chiao City, Taipei Hsien, Taiwan

[21] Appl. No.: 2,157

[22] Filed: Jan. 11, 1993

[51] Int. Cl.[5] ..... H01R 33/18

[52] U.S. Cl. ..... 439/188; 200/51.10

[58] Field of Search ..... 439/137, 140, 147, 188, 439/509, 513, 360, 611, 619; 200/51.10, 51.09

[56] References Cited

U.S. PATENT DOCUMENTS

| | | | |
|---|---|---|---|
| 3,915,536 | 10/1975 | Glantz | 439/188 |
| 3,936,122 | 2/1976 | Hagelberg | 439/188 |
| 4,047,167 | 9/1977 | Helena | 200/51.10 |
| 4,513,182 | 4/1985 | Juntii | 200/51.10 |
| 4,768,966 | 9/1988 | Doherty | 439/140 |
| 5,030,124 | 7/1991 | Lorentzon | 439/188 |
| 5,069,632 | 12/1991 | Avitan | 439/188 |
| 5,139,343 | 8/1992 | Lin . | |
| 5,145,391 | 9/1992 | Alwine | 439/188 |
| 5,201,853 | 4/1993 | Alwine | 439/188 |

FOREIGN PATENT DOCUMENTS

| | | | |
|---|---|---|---|
| 0077046 | 4/1983 | European Pat. Off. | 439/188 |

*Primary Examiner*—Paula A. Bradley

*Attorney, Agent, or Firm*—Lowe, Price, LeBlanc & Becker

[57] ABSTRACT

Disclosed is a light socket and socket adapter including a socket adapter inserted in a light socket of a decorative light string to electrically connect an electric ornament to the electric circuit of the decorative light string. The two opposite contacts of the light socket are short-circuited by a conductive spring as the socket adapter was disconnected, and therefore the integrity of the electric circuit of the decorative light string is maintained.

2 Claims, 5 Drawing Sheets

LIGHT SOCKET AND SOCKET ADAPTER

BACKGROUND OF THE INVENTION

The present invention relates to a light socket and socket adapter, and more particularly relates to a socket adapter for a light socket as constructed in accordance with U.S. Pat. No. 5,139,343.

Various light sockets for decorative strings or Christmas tree light assemblies are known. U.S. Pat. No. 5,139,343 discloses a light socket having two opposite contacts respectively connected to the electric circuit of a decorative light string or Christmas tree light assembly, and a conductive spring disposed below and in contact with the two opposite contacts. As a light bulb was inserted in the light socket, the two opposite contacts are respectively connected to the two opposite contacts of the light socket, and at the same time, an insulative tip of the light bulb conductive spring disconnect the conductive spring from the two opposite contacts of the light socket.

SUMMARY OF THE INVENTION

An object of the present invention is to provide a socket adapter for connecting any of a variety of electric ornaments to a light socket of a decorative light string or Christmas tree light assembly. Another object of the present invention is to provide a socket adapter which is inexpensive to manufacture and practical in function.

DETAILED DESCRIPTION OF THE PREFERRED EMBODIMENT

Figure 1:
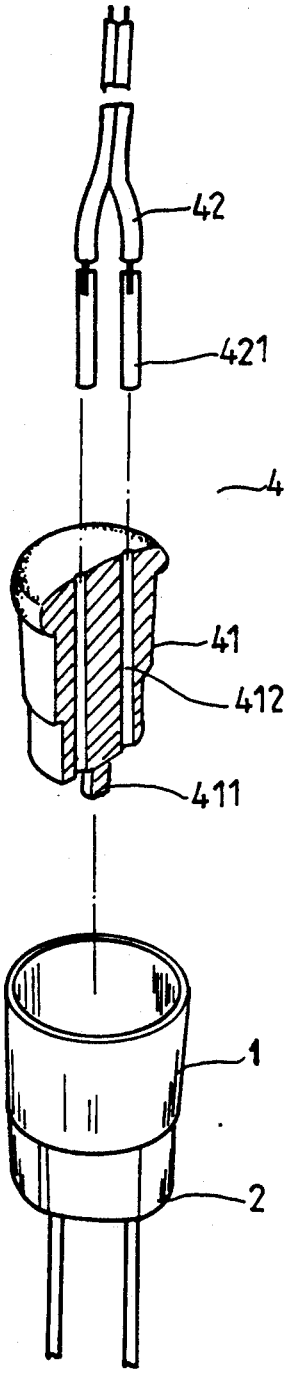
FIG. 1 is an exploded view of the preferred embodiment of the present invention.
Figure 2:
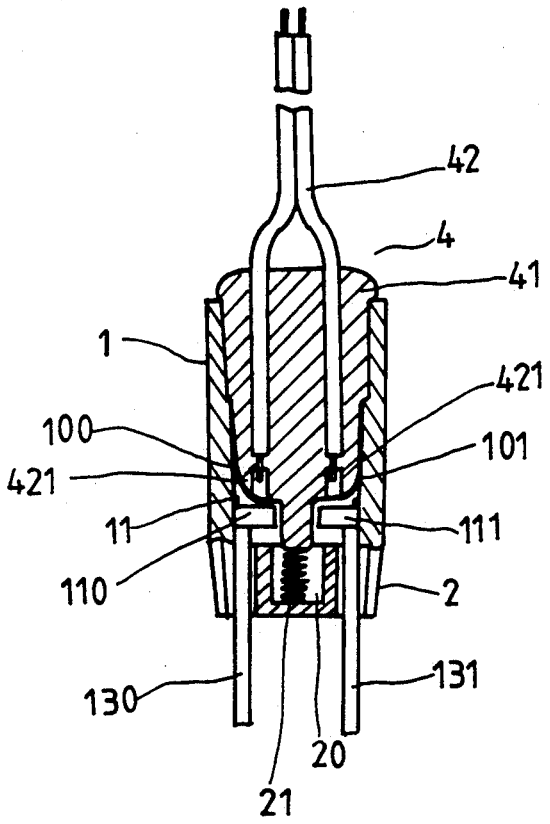
FIG. 2 is an assembly view thereof.
Figure 3:
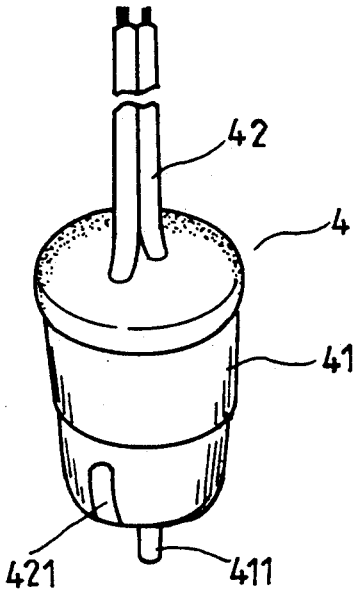
FIG. 3 is an elevational view of the socket adapter.

Referring to FIGS. 1, 2 and 3, the present invention is generally comprised of a light socket, which comprises a socket body 1 connected to a socket base 2, a light bulb 3, and a socket adapter 4. The socket body 1 comprises two opposite conductive spring leaves 100,101 spaced by a gate 11. The socket base 2 comprises two terminals 110,111 respectively connected to the two opposite ends of the electric circuit of a decorative light string or Chrisms tree light assembly by electric wires 130,131, a conductive spring 21 received in a center recessed hole 20 thereof and stopped by the terminals 110,111 below the gate 11. Normally, the terminals 110,111 of the electric wires 130,131 are connected by the conductive spring 21. The socket adapter 4 comprises a body 41 made from a plastic material through the process of injection molding, which has a tip 411 at one end and through holes 412 in longitudinal direction, and two electric wires 42 with terminals 421 respectively inserted through the through holes 412. Inserting the socket adapter 4 into the socket body 1 causes the tip 411 to squeeze the conductive spring 21 downwards from the terminals 110,111, and at the same time, the spring leaves 100,101 are respectively squeezed by the terminals 421 of the electric wires 42 to contact the terminals 110,111 of the electric wires 130,131. If the socket adapter 4 disconnects from the socket body 1, the terminals 110,111 of the electric wires 130,131 become short-circuited by the conductive spring 21.

Figure 4:
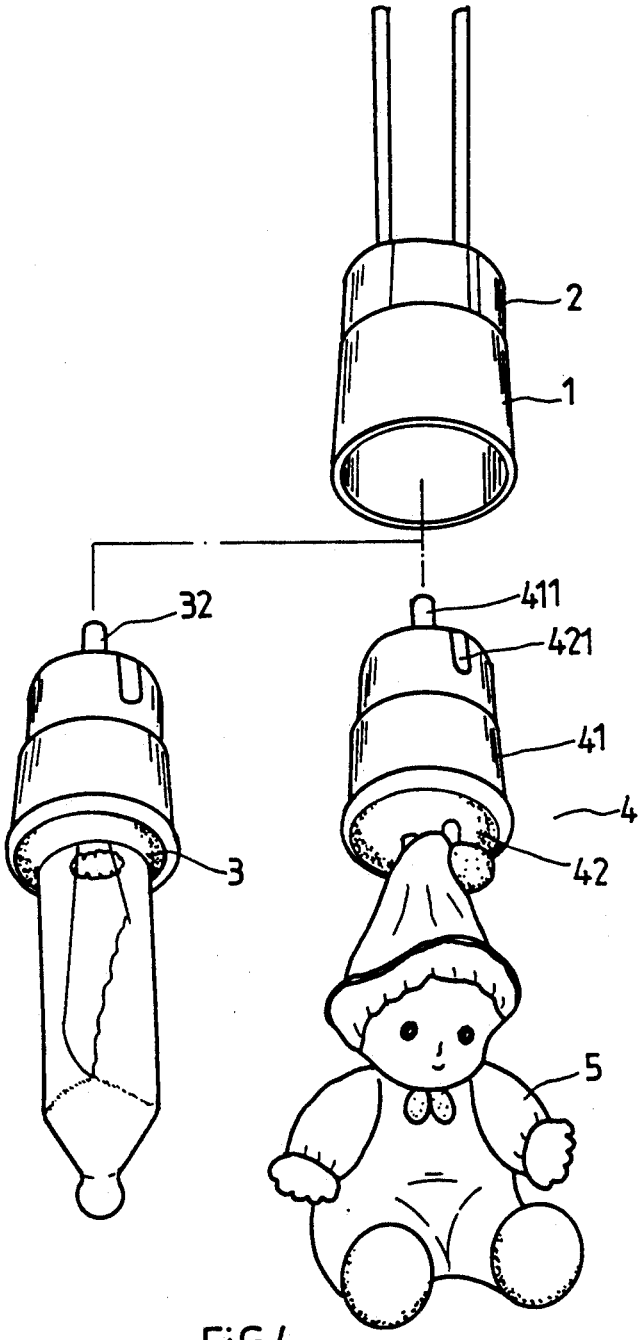
FIG. 4 illustrates a light bulb and the socket adapter to be alternatively connected to the light socket.

Referring to FIG. 4, a light bulb 3 in accordance with the present invention comprises an insulative tip 32 projected from its base. Inserting the light bulb 3 into the socket body 1 causes the insulative tip 32 to separate the conductive spring 21 from the terminals 110,111 of the electric wires 130,131, and at the same time, the two opposite contacts (not shown) of the light bulb 3 become respectively connected to the terminals 110,111 through the conductive springs 100,101. If the light bulb is not properly positioned, the terminals 110,111 of the electric wires 130,131 become short-circuited by the conductive spring 21, and therefore the integrity of the electric circuit of the decorative light string or Christmas tree light assembly is maintained.

Figure 5:
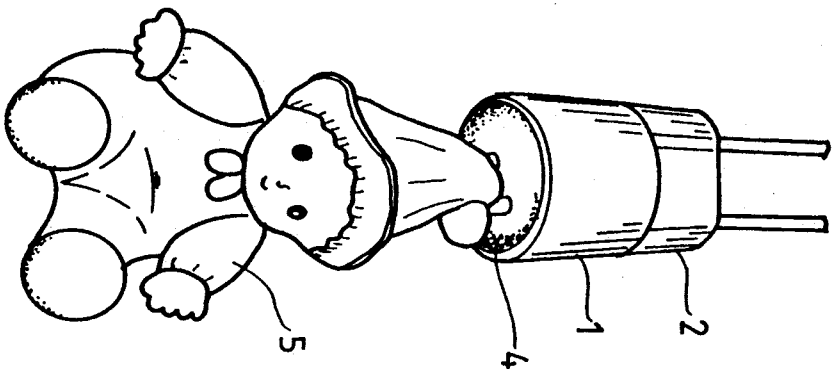
FIG. 5 illustrates a music IC ornament connected to the light socket by the socket adapter.

Referring to FIG. 5 and FIG. 4 again, an electric ornament 5 (for example, a music IC ornament or decorative light) may be connected to the light socket 1,2 by the socket adapter 4. Therefore, light bulbs and different music IC ornaments or decorative lights can be connected to a decorative light string or Christmas tree light assembly in accordance with the present invention and controlled by a control circuit to emit light or produce sound.

What is claimed is:

1. A socket adapter for a light socket of the type having two opposite contacts on the inside connected to the two opposite ends of an electric circuit of a decorative light string and a conductive spring stopped by said contacts in an inside hole thereof, the socket adapter comprising a solid body made from a plastic material through the process of injection molding having having a tip at one end, two electric wires inserted through two longitudinal through holes on said solid body, the electric wires of said socket adapter being each coupled with a respective terminal, whereby inserting said socket adapter into said light socket causes the tip of said socket adapter to disconnect said conductive spring from said contacts for permitting said contacts to be respectively connected to the terminal on either electric wire of said socket adapter.

2. The socket adapter of claim 1 wherein an electric ornament is electrically connected to the electric wires of said light socket by said socket adapter.

* * * * *